US010227750B2

(12) United States Patent
Walker

(10) Patent No.: US 10,227,750 B2
(45) Date of Patent: Mar. 12, 2019

(54) DEVICE AND METHOD FOR FOUNDATION DRAINAGE

(71) Applicant: Robert P. Walker, Mundelein, IL (US)

(72) Inventor: Robert P. Walker, Mundelein, IL (US)

( * ) Notice: Subject to any disclaimer, the term of this patent is extended or adjusted under 35 U.S.C. 154(b) by 0 days.

(21) Appl. No.: 15/866,210

(22) Filed: Jan. 9, 2018

(65) Prior Publication Data

US 2018/0127946 A1 May 10, 2018

Related U.S. Application Data

(63) Continuation of application No. 15/204,550, filed on Jul. 7, 2016, now Pat. No. 9,879,400.

(51) Int. Cl.

| | |
|---|---|
| ***E02D 19/00*** | (2006.01) |
| ***E02D 31/02*** | (2006.01) |
| ***E02D 19/06*** | (2006.01) |

(52) U.S. Cl.

CPC ..... *E02D 31/025* (2013.01); *E02D 19/06* (2013.01)

(58) Field of Classification Search

CPC ..... E04F 15/185; E04F 13/007; E04F 13/21; E04B 1/70; E04B 1/7612

USPC ..... 52/302.1, 302.6, 302.3, 309.4, 745.19, 52/589.1, 578, 159.5, 169.1, 62, 60; 405/43, 50; 442/38

See application file for complete search history.

(56) References Cited

U.S. PATENT DOCUMENTS 3,654,765 A * 4/1972 Healy ..... E02B 11/005 210/346
4,704,048 A * 11/1987 Ahlgrimm ..... E02D 31/02 210/170.07
5,444,950 A 8/1995 Kelly et al.
6,684,579 B2 * 2/2004 Brunson ..... E04B 1/7061 52/169.14
8,572,917 B2 11/2013 Gartz et al.
8,590,242 B1 11/2013 Ogorchock
8,635,833 B2 1/2014 Anderson
9,428,913 B2 8/2016 Salmon-Folgueras et al.
9,879,400 B1 * 1/2018 Walker ..... E02D 31/025
2002/0152696 A1 10/2002 Ruiz et al.

(Continued)

FOREIGN PATENT DOCUMENTS

EP 0217717 A2 4/1987
EP 2873695 B1 2/2016

(Continued)

OTHER PUBLICATIONS

Owens Corning Foam Insulation, LLC, Foamular Insul-Drain Extruded Polystyrene (XPS) Insulation Board, Product Data Sheet, Mar. 2015, p. 1, Pub. No. 45426-C, The Pink Panther 1964-2015 & Metro-Goldwyn-Mayer Studios Inc., Toledo Ohio, USA.

(Continued)

*Primary Examiner* — Chi Q Nguyen
(74) *Attorney, Agent, or Firm* — Quarles & Brady LLP

(57) ABSTRACT

A drainage system to be installed against a foundation of a building. The drainage system includes a drainage board having a plurality of channels extending from a bottom side along a front face thereof, and a portion of filter fabric attached to a rear face of the drainage board that covers the front face of the drainage board. The plurality of channels comprise a plurality of left channels and a plurality of right channels that intersect to form a crisscross pattern.

20 Claims, 4 Drawing Sheets

(56) References Cited

U.S. PATENT DOCUMENTS

| | | | |
|---|---|---|---|
| 2003/0024192 | A1 | 2/2003 | Spargur |
| 2005/0081468 | A1* | 4/2005 | Wilson ..... E04F 13/007 52/528 |
| 2006/0021726 | A1 | 2/2006 | Wells |
| 2006/0112653 | A1 | 6/2006 | Hogenson |
| 2008/0034690 | A1 | 2/2008 | Gartz et al. |
| 2009/0159177 | A1 | 6/2009 | Muncaster et al. |
| 2009/0188172 | A1 | 7/2009 | DuCharme et al. |
| 2010/0058657 | A1 | 3/2010 | Fishburn |
| 2011/0030274 | A1 | 2/2011 | Buist |
| 2011/0058897 | A1 | 3/2011 | Jones et al. |
| 2012/0159893 | A1 | 6/2012 | Anderson |
| 2013/0333285 | A1 | 12/2013 | Buist et al. |
| 2014/0115989 | A1 | 5/2014 | Sievers et al. |
| 2015/0068147 | A1 | 3/2015 | Huff |
| 2015/0082722 | A1 | 3/2015 | Kalkanoglu et al. |
| 2015/0337535 | A1 | 11/2015 | Salmon-Folgueras et al. |
| 2016/0242363 | A1 | 8/2016 | Buist et al. |

FOREIGN PATENT DOCUMENTS

| | | | |
|---|---|---|---|
| EP | 2873779 | B1 | 2/2016 |
| EP | 2630313 | B1 | 9/2016 |
| WO | 2009094075 | A1 | 7/2009 |
| WO | 2009132439 | A1 | 11/2009 |
| WO | 2012174408 | A2 | 12/2012 |
| WO | 2016118490 | A1 | 7/2016 |
| WO | 2016118493 | A1 | 7/2016 |

OTHER PUBLICATIONS

Minerals Technologies CETCO, Drainage products-Reduce the risk of major structural damage with the right foundation drainage products, Website, http://www.cetco.com/en-us/Products/Building-Materials/Drainage-Products, 2016, Nov. 4, 2016, CETCO.

Hello Trade, Divize Isover-Eps Dd Universal Drainage Boards, Website, http://www.hellotrade.com/divize-isover/eps-dd-universal-drainage-boards.html, Nov. 4, 2016, HelloTrade.com.

Tremco Commercial Sealants & Waterproofing, TREMDrain 3000, Website, http://www.tremcosealants.com/products/tremdrain-3000.aspx, 2016, Nov. 4, 2016, Tremco Incorporated.

Waterproof Magazine, Below Grade Residential: Drainage Boards & Footing Draiins, Website, https://www.waterproofmag.com/back_issues/200711/drainage.php, 2007, Nov. 4, 2016, Summit Publishing, LLC, USA.

W.R. Meadow, Inc., Mel-Drain Rolled Matrix Drainage System, Website, https://www.wrmeadows.com/mel-drain-rolled-matrix-drainage-system/, 2016, Nov. 4, 2016, W. R. Meadows, Inc., USA.

* cited by examiner

DEVICE AND METHOD FOR FOUNDATION DRAINAGE

CROSS REFERENCE TO RELATED APPLICATIONS

This application is a continuation of and claims priority to U.S. patent application Ser. No. 15/204,550 filed on Jul. 7, 2016, now U.S. Pat. No. 9,879,400, the entire contents of which are incorporated herein by reference.

REFERENCE REGARDING FEDERALLY SPONSORED RESEARCH OR DEVELOPMENT

Not applicable.

SEQUENTIAL LISTING

Not applicable.

BACKGROUND OF THE DISCLOSURE

1. Field of the Disclosure

The present disclosure relates to a drainage system installed along an outer foundation surface of a building, the system including a drainage board and filter fabric attached thereto.

2. Description of the Background of the Disclosure

Building foundations typically require a sturdy footing and a vapor-proofed, reinforced concrete pad attached thereto, the footing sitting on a bed of compact crushed stone. There are currently a number of ways to vapor-proof a foundation, which typically involve either water-proofing or damp-proofing. Water-proofing is a treatment that prevents the passage of water under hydrostatic pressure, and damp-proofing is a treatment that generally prevents the passage of water in the absence of hydrostatic pressure. Hydrostatic pressure is a force that is exerted on a foundation by water that is in the ground, i.e., groundwater, that surrounds the foundation. Many foundations require at least one form of water-proofing or damp-proofing.

After installation of the foundation of a building, a builder typically damp-proofs the outer wall thereof. Historically, builders have applied one or more coats of unmodified asphalt to the exterior side of building foundation walls from the footings to slightly above grade, i.e. ground level. Asphalt comes in various forms suitable for brushing, rolling, squeegeeing, spraying, or toweling. Water-based asphalt emulsions have also been applied to damp substrates along foundations, including onto green concrete. Such emulsions can also be used for gluing extruded polystyrene foam insulation to foundation walls. Cutback asphalts, which are solvent based, have also historically been used for damp-proofing foundations.

Water-proofing is different than damp-proofing in that, while water-proofing also may involve the application of one or more layers of asphalt, it further includes reinforcement with one or more layers of fiberglass, cotton fabric, or an elastomeric membrane. Recently, the trend has been to apply spray liquids that cure to form elastomeric membranes, as these are cost effective, can be applied quickly to concrete or masonry, and cure to form seamless, self flashing membranes. However, successful application of spray-on liquids requires significant preparation of substrates, and the spraying surfaces must be clean and dry or else the final membrane can blister or pinhole. Further, water that interfaces with the sprayed-on elastomeric membrane may not flow down the membrane in a uniform fashion, which can cause pooling underground. Spraying liquids to waterproof a foundation is thus an expensive and imperfect solution to the problem of keeping water out of foundation walls.

Dimple sheeting can also be used for water-proofing. Dimple sheeting is a low cost water-proof membrane that doubles as a drainage mat and looks like an egg carton in profile. It is rolled over concrete, masonry, or wood foundations and tacked up with washered nails. It can be installed over substrates in any condition and is subsequently backfilled with dirt, clay, sand, etc. The dimple membrane repels water and forms air gaps against the basement wall that allows water to channel down to footing drains below the foundation. However, dimple sheeting may collapse or buckle under pressure created by the backfilled material, as the sheet is generally not more than a few millimeters thick.

In addition to vapor-proofing, an additional aspect of protecting a foundation is providing insulation. Many products currently exist as below-grade insulation panels. Currently, some products exist that provide both insulation and drainage. Referring to one such example, a panel exists that directs groundwater to perimeter drains without affecting the panel's R-value, which is a unit of thermal resistance for an insulation panel. The channels provided within the panel are covered by a spin-bonded filter fabric that admits water but keeps soil out. The water enters through the filter fabric and then drains down one or more vertical channels in the panel. However, while dirt, clay, and sand are generally kept from entering the channels by the filter fabric, the vertical channels may become clogged by material that makes it through the filter fabric, which can prevent water from properly flowing down the one or more channels cut out of the foam. Still further, the use of fabric has historically only involved the use of a single, taught piece of fabric, which typically becomes disturbed, torn, or ripped away by the backfill over time as the backfill settles. As a result, there is a need for a device including a water-proof, insulative board that has channels provided therein that will not clog due to sediment, and a filter fabric that will not, with proper installation, tear or rip, since the filter fabric prevents sediment from entering the channels of the drainage board.

Therefore, it would be desirable to have a system that addresses one or more of the drawbacks presented above.

SUMMARY

According to one aspect, a method of utilizing a drainage system is provided. The method includes the steps of attaching a filter fabric to a rear side of a drainage board, folding the filter fabric over a top side and a front side of the drainage board, forming a portion of the filter fabric that is unattached from the drainage board into a settling strip, and installing the drainage board against a wall of a foundation.

According to a different aspect, a method of utilizing a drainage system comprises attaching a filter fabric to a rear side of a drainage board, the drainage board having a plurality of channels on a front side thereof, and covering at least a portion of the front side of the drainage board with the filter fabric. Further, the method includes forming a portion of the filter fabric into a settling strip and installing a rear side of the drainage board against a wall of a foundation.

According to another aspect, a drainage system is provided. The drainage system comprises an impenetrable drainage board having a front side with a plurality of channels extending inwardly therefrom and a filter fabric attached to a rear side of the drainage board that covers at least a portion of a top side and the front side of the drainage board.

DETAILED DESCRIPTION OF THE DRAWINGS

The devices and methods disclosed herein relate generally to insulated drainage boards designed to assist in the reduction of hydrostatic pressure that exists around a building foundation when groundwater is present by allowing water to pass through a filter fabric into one or more drainage channels downward to a drain tile and pump system. The embodiments disclosed herein further provide a thermo barrier between the building foundation and the sediment that comprises the surrounding ground, which helps to maintain a stable temperature year-round while minimizing the effects of the freeze-thaw cycle. The devices and methods disclosed herein further reduce the potential for wall cracks and protect the waterproofing membrane, i.e., the filter fabrics, from damage during backfill and settling of the ground.

FIGS. 1-6 generally depict a drainage system 20 as described herein. The drainage system 20 includes a drainage board 22, which may be formed from fiberglass, plastic fibers, natural fibers, compressed foam beads, foam boards, which may be made, e.g., from extruded polystyrene, polyisocyanurate, phenolic, polyurethane, or cementitious material. The drainage board 22 may have an R-value of between about 1 and about 15 or between about 5 and about 12 or between about 8 and about 11 or about 10. In one embodiment, the drainage board 22 comprises expanded polystyrene foam. In another embodiment, the drainage board 22 comprises extruded polystyrene foam (XPS). In still another embodiment, the drainage board 22 comprises polyisocyanurate, which may include a layer of foil provided thereon. In a further embodiment, the drainage board 22 comprises expanded polystyrene foam, which may be manufactured by expanding spherical beads in a mold, and using heat and pressure to fuse the beads together.

Figure 1:
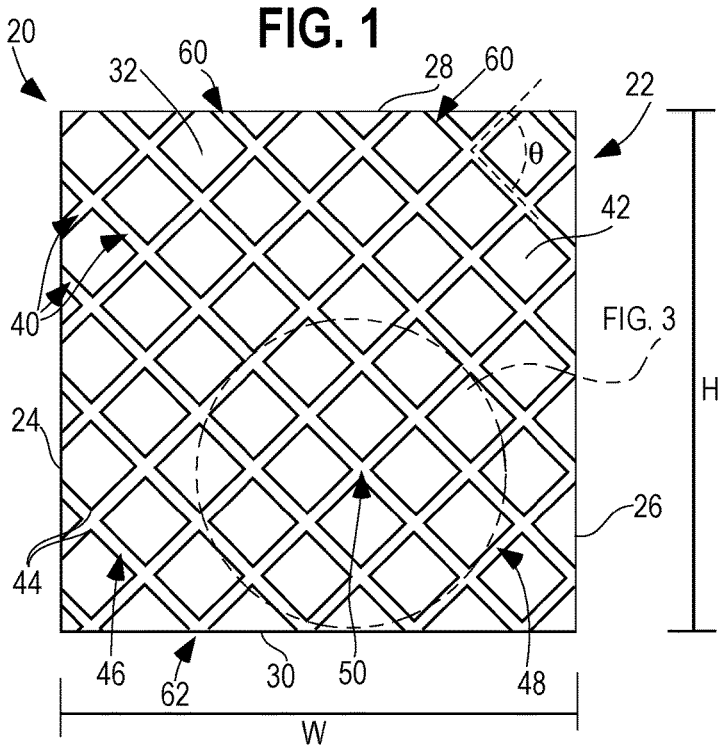
FIG. 1 is front elevational view of a drainage board as described herein.

Turning to FIG. 1, a front elevational view of the drainage board 22 is illustrated. The drainage board 22 is defined by a left side 24, a right side 26, a top side 28, a bottom side 30, a front face 32, and a rear face 34 (see FIGS. 2, 5, and 6). In some aspects, the sides, 24, 26, 28, 30, and the faces 32, 34 are generally substantially planar. The drainage board may be rectangular shaped and, in one aspect, may be square shaped. The left side 24 and the right side 26 may have a height dimension H of between about 1 feet and about 22 feet, or between about 6 feet and about 16 feet or about 8 feet Further, the bottom side 30 and the top side 28 may have a width dimension W of between about 1 foot and about 10 feet, or between about 2 feet and about 8 feet or about 4 feet. In some embodiments, the drainage board 22 may have a triangular or trapezoidal or other shape.

The drainage board 22 includes a plurality of channels 40 formed within the front face 32. In one aspect, the channels 40 generally crisscross the drainage board 22, forming diamond shaped (or 90 degree offset square shaped) portions 42 having a plurality of corners 44. In one aspect, the channels 40 may be pre-formed in the drainage board 22. In another aspect, the channels 40 are cut out of the drainage board 22 with a saw or another machining device. In some embodiments, the portions 42 have straight sides, and, thus, the corners 44 are sharp. In other embodiments, the corners 44 are rounded such that the sides may be curvilinear. In some embodiments, the portions 42 are generally the same shape excluding the portions near the left side 24, right side 26, top side 28, or bottom side 30. In other embodiments, the portions 42 have different shapes. In still further embodiments, the portions 42 are generally the same shape, but are of differing sizes. As one of ordinary skill in the art would recognize, in any embodiment disclosed herein, the greatest thickness of the drainage board 22 may be along one of the portions 42, while the thinnest thickness may be along a portion of the channels 40.

Referring to FIG. 1, in a preferred embodiment, the channels 40 include left channels 46 and right channels 48 that extend upward from the bottom side 30 of the drainage board 22 at an incline relative to a direction defining the height H, i.e., in a left direction and a right direction, respectively. The left channels 46 and the right channels 48 intersect at a plurality of intersection points 50. In some embodiments, the left channels 46 and the right channels 48 are defined by straight lines between intersection points 50. In other examples, the left and right channels 46, 48 may be formed by zigzag lines between intersection points 50. In other embodiments, the left and right channels 46, 48 may be defined by curved lines between intersection points 50. For example, in some embodiments, the left channels 46 and the right channels 48 are defined by sinusoidal-type waves either between intersection points 50 or along at least a portion of the front face 32.

Still referring to FIG. 1, wherein the diagonal channels 40 are formed from left and right channels 46, 48, groundwater that enters the channels 46, 48 flows downward toward the bottom side 30 due to gravity. The channels 46, 48 are formed in such a way that if a blockage 52 (see FIG. 3) occurs at one point, rather than water building up toward the top side 28, as water would in a drainage board having only vertical, non-intersecting channels, the water can still flow through the channels 40 around the blockage 52. In the disclosed embodiments, and still referring to FIG. 1, the left and right channels 46, 48 are formed in such a way that the intersections thereof form an angle Θ of about 90 degrees. However, in other embodiments, the angle Θ may be acute, and may be between about 5 degrees and about 89 degrees, or between about 20 degrees and about 70 degrees, or about 50 degrees. In other embodiments, the angle Θ may be obtuse, and may be between about 91 degrees and about 175 degrees, or between about 110 degrees and about 160 degrees, or about 125 degrees. In one aspect, the drainage system 20 may be made from 2 inch extruded polystyrene. In that instance, the system 20 may be cut with a table saw having a plurality of blades, e.g., 60 blades, and the channels 46, 48 may be created by running the drainage board 22 through the table saw twice in 90° offset passes.

Still further, in other embodiments, the angle Θ may be different along different parts of the front face 32 of the drainage board 22. For example, in some embodiments, the angle Θ may be smaller toward the top side 28 of the drainage board 22, and may be larger toward the bottom side 30 of the drainage board 22. In such an embodiment, the channels 40 may emanate from a singular point (not shown) centered along the bottom side 30 of the drainage board 22 such that the groundwater flows to the singular point or only a few points. The angle Θ may be modified along the front face 32 of the drainage board 22 in response to a number of considerations, such as the desired strength, insulation coefficient, and drainage rate of the drainage board 22. In still further embodiments, vertical channels (not shown) may be included that intersect the left and right channels 46, 48, e.g., at the intersection points 50 or at other locations along the channels 46, 48, to allow for more drainage of ground water.

As illustrated, a plurality of entryways 60 are defined by cutouts within the drainage board 22. The entryways 60 are formed to allow water to enter the channels 46, 48 and, due to gravity, flow toward the bottom side 30 of the drainage board 22. It also will be appreciated by one of ordinary skill in the art that water may enter the channels at other points along the height of the drainage board 22. As one of ordinary skill in the art would recognize, in a preferred embodiment, the bottom side 30 and the top side 28 of the drainage board 22 are mirror images of one another, and can be generally interchanged. As a result, the entryways 60 may also be exits 62 for the ground water depending upon the orientation of the board 22. However, in some embodiments, as shown in FIG. 1, the top side 28 may have more entryways 60 than the bottom side 30 has exits 62 to allow more entry points for the ground water, or vice versa. The entryways 60 and exits 62 may be defined by the height of the drainage board 22, the tooling of the device that cuts away the channels 46, 48, and the available space along the front face 32 of the drainage board 22. In other embodiments, more or fewer entryways 60 may be included in response to considerations such as the hydrostatic pressure at the location of the foundation, the amount of water that is expected to drain through the drainage board 22, or any other consideration known to those of ordinary skill in the art.

Figure 2:
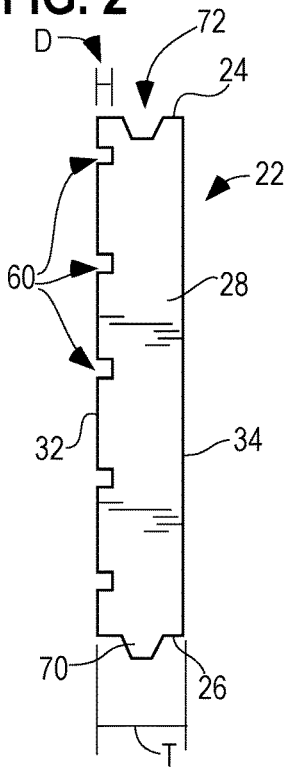
FIG. 2 is a top elevational view of a different embodiment of a drainage board.
Figure 3:
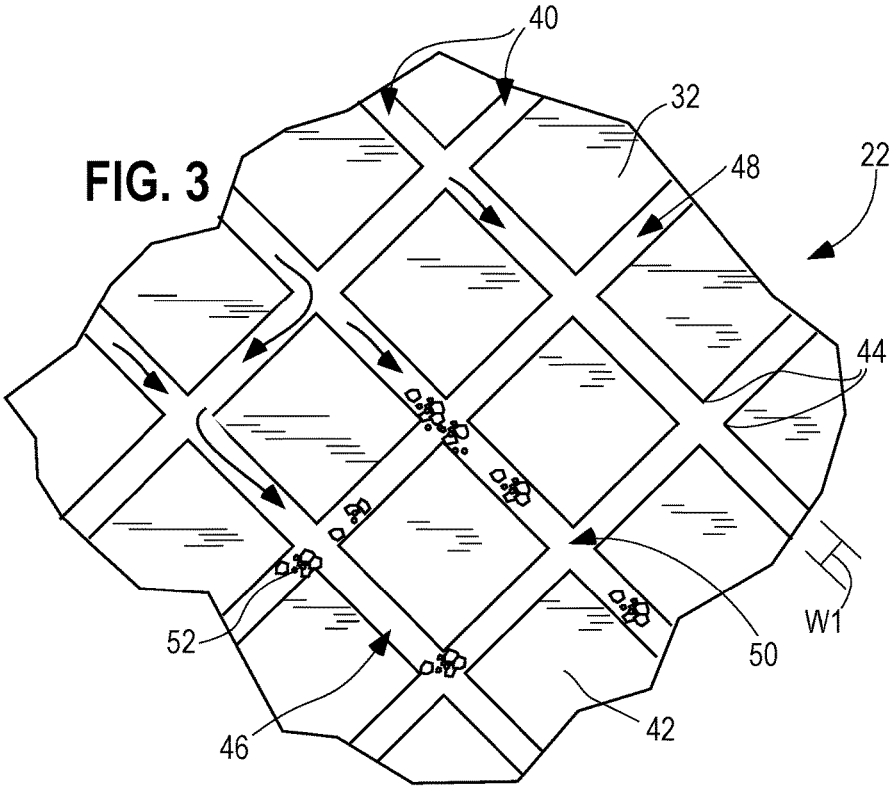
FIG. 3 is an enlarged portion of the drainage board of FIG. 1 showing the flow of water when a blockage exists within a drainage channel.

As seen in FIG. 2, a thickness of the drainage board is defined by a thickness T. The thickness T may be between about 0.5 inches and about 5 inches, or between about 1 inch and about 4 inches, or between about 1.5 inches and about 3 inches, or about 2 inches. A depth D of the channels 40 is also illustrated in FIG. 2. The depth D may be between about 1/16 inch and about 1 inch, or between about 2/16 inch and about 13/16 inch, or about 5/16 inch. The depth D of the channels may vary along the drainage board 22 depending on the desired rate of drainage of the ground water that enters the channels 40. The channels 40 may also have a width W1 (see FIG. 3) of between about 1/16 inch and about 1 inch, or between about 2/16 inch and about 13/16 inch, or about 5/16 inch. The channels 40 may have a generally rectangular cross-sectional shape, or may have a semi-circular cross-sectional shape. The channels 40 may also have a triangular, pentagonal, heptagonal, or octagonal cross-sectional shape. Further, more or fewer channels 40 than shown in the illustrated embodiments may be included.

Still referring to FIG. 2, a top elevational view of another embodiment of the drainage board 22 is shown. As seen in that figure, a tongue 70 and a groove 72 may be included interchangeably along the left side 24 and the right side 26 of the drainage board 22. The tongue 70 and groove 72 may act as a lock and key mechanism to allow two or more of the drainage boards 22 to interlock when placed into use. The tongue 70 may be have a generally trapezoidal cross-sectional shape, or may have another cross-sectional shape, such as a semi-circle, a triangle, a square, a rectangle, a pentagon, a hexagon, a heptagon, or an octagon. The groove 72 preferably has the same corresponding shape as the tongue 70, which allows the one or more drainage boards 22 to interlock with one another. An adhesive or another securement mechanism may be included within the tongue 70 and groove 72.

Figure 4:
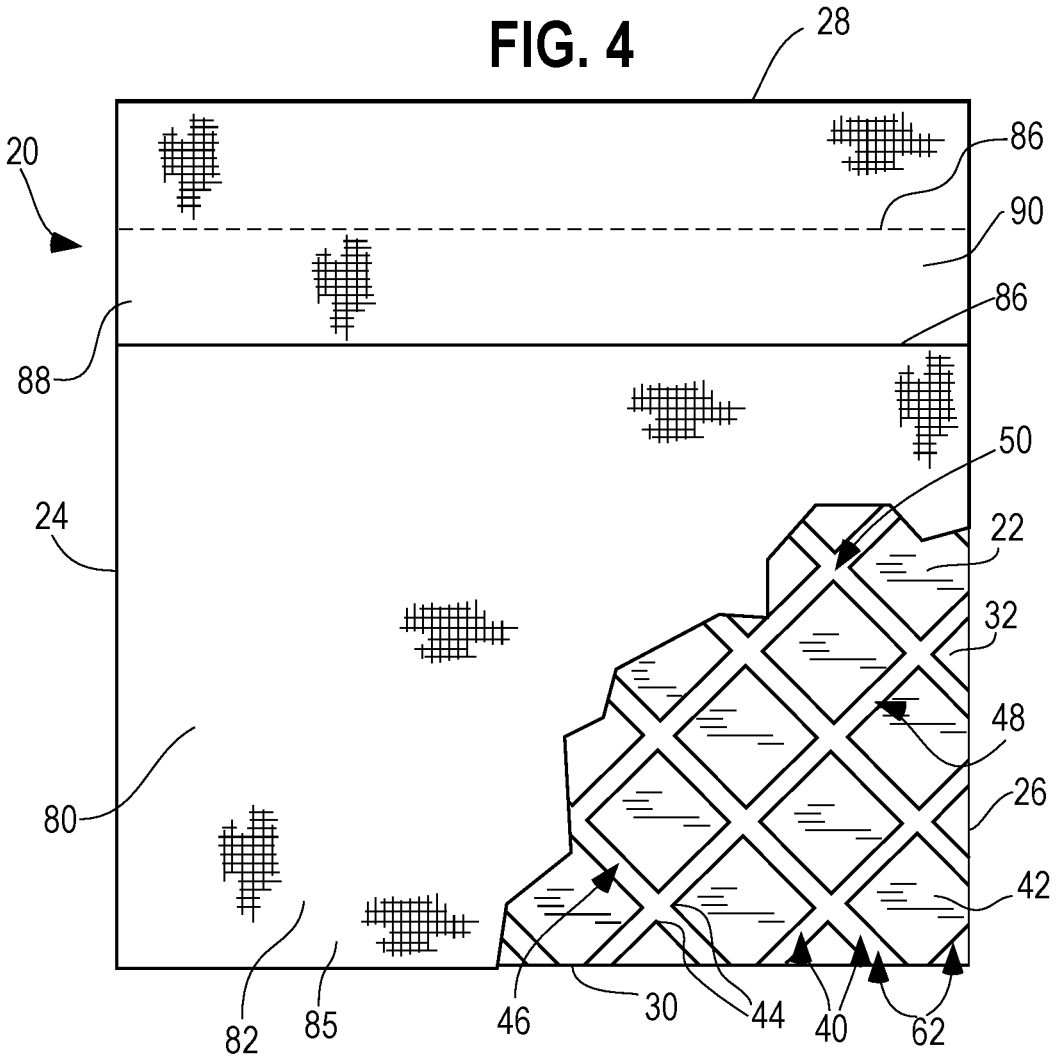
FIG. 4 is a front elevational view of a drainage board having a filter fabric provided thereon, which comprises a settling strip as disclosed herein.
Figure 5:
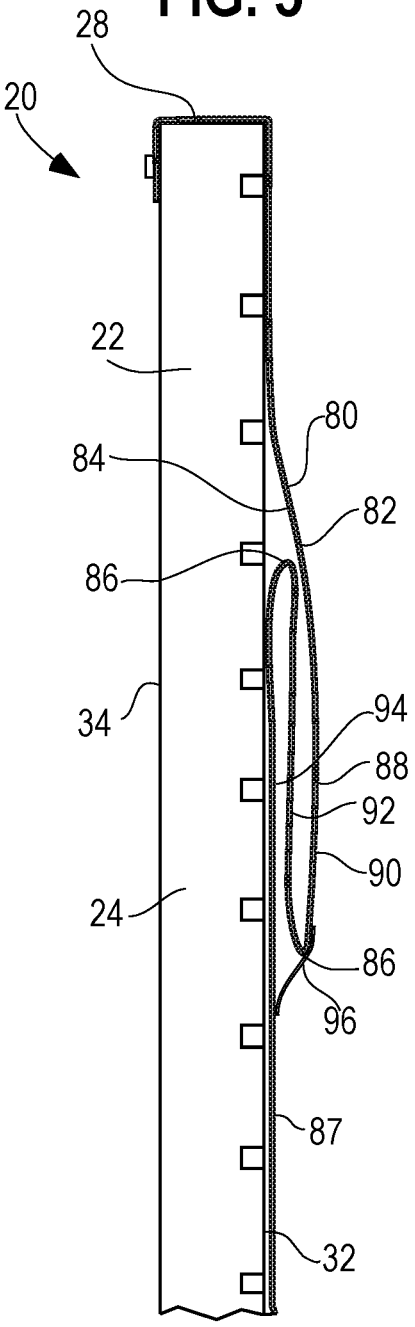
FIG. 5 is a side elevational view of the drainage board of FIG. 4 in a non-backfilled state.
Figure 6:
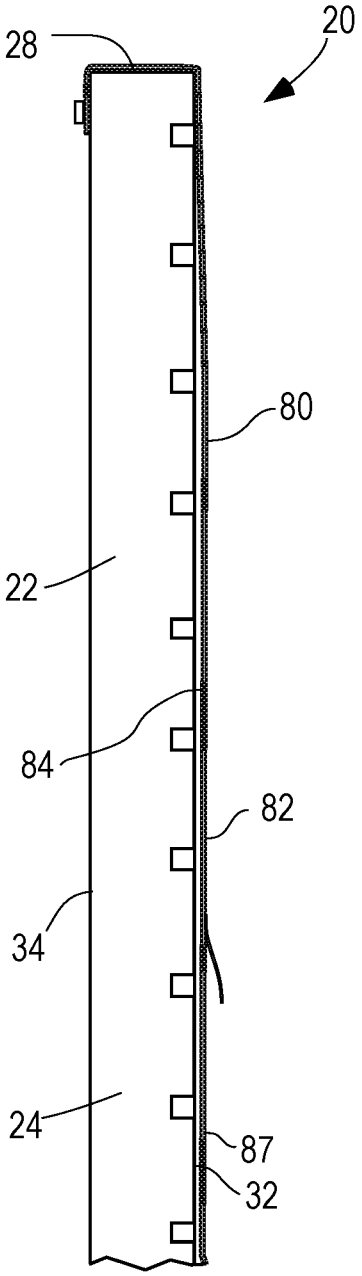
FIG. 6 is a side elevational view of the drainage board of FIG. 4 in a backfilled state.

Now referring to FIGS. 4-6, the drainage board 22 is shown having a filter fabric 80 provided thereover. The filter fabric 80 generally has an outer surface 82 and an inner surface 84. The filter fabric 80 may be a geotextile, which is a permeable textile material used to increase soil stability, provide erosion control and/or aid in drainage. In some embodiments, the filter fabric 80 is a natural fiber. In other embodiments, the filter fabric 80 is comprised of a synthetic polymer such as polypropylene, polyester, polyethylene, or a polyamide. The filter fabric 80 may be woven, knitted, or non-woven. In some embodiments, the filter fabric 80 is a non-woven geotextile. In non-woven embodiments, the filter fabric 80 may comprise US 80 NW, US 90 NW, US 100 NW, US 120 NW, US 160 NW, US 180 NW, US 205 NW, US 300 NW, or US 380 NW. The filter fabric 80 may have a weight of between about 3.1 oz/sy (ounce per square yard) and about 16 oz/sy, or between about 4.0 oz/sy and about 8.0 oz/sy, or about 6.0 oz/sy. The filter fabric 80 may further have a tensile strength of between about 801 bs and about 3801 bs, or between about 1001 bs and about 2501 bs, or about 1601 bs. Still further, the filter fabric 80 may be defined as having a water flow rate of between about 50 g/min/sf (gallons per minute per square foot) and about 150 g/min/sf, or between about 80 g/min/sf and about 140 g/min/sf, or about 110 g/min/sf.

Still referring to FIG. 4, the filter fabric 80 is shown cutaway to illustrate the channels 40 provided within the drainage board 22 underneath. As seen in FIGS. 5 and 6, the filter fabric 80 may cover the entire top side 28 and front face 32 of the drainage board 22. Still further, and as will be discussed in greater detail below, the filter fabric 80 may be attached to the rear face 34 of the drainage board 22. In some aspects, the filter fabric 80 is attached to the rear face 34 of the drainage board 22 approximately a foot below the top side 28 thereof. The filter fabric 80 may be attached to the rear face 34 with any one of staples, adhesion, rivets, pins, or any other method of coupling known to those of ordinary skill in the art. The filter fabric 80 may then be disposed over the top side 28 of the drainage board 22 and along the front face 32 thereof. In one aspect, the filter fabric 80 is not attached to the front face 32 of the drainage board 22, which may allow the filter fabric 80 to slide up and down the front face 32, as will be discussed in greater detail hereinafter below. In some aspects, and referring to FIG. 4, an end 85 of the filter fabric 80 nearest the bottom side 30 of the board 22 is unsecured. In some aspects, after installation of the system 20, but before backfilling, the end 85 is even with the bottom side 30 of the board 22, such that extra slack of the filter fabric 80 will exist after settling of the backfill.

Referring now to FIGS. 5 and 6, side elevational views of the drainage system 20 are shown, including the drainage board 22 and the filter fabric 80. The drainage system 20 is shown in a non-backfilled state in FIG. 5 and is shown in a backfilled state in FIG. 6. In the non-backfilled state, the filter fabric 80 is shown having two folds 86, thereby creating a multi-layered settling strip 88. In some embodiments, the system 20 includes more folds 86. The settling strip 88 comprises an outer segment 90, an intermediate segment 92, and an inner segment 94 of the filter fabric 80. As shown in FIG. 6, in the backfilled state, a lower portion 87 of the filter fabric 80 is pulled downward, thus the settling strip 88 disappears, due to being pulled along the front face 32 by backfill, thus, the segments 90, 92, 94 no longer exist in this state. In some aspects, the settling strip 88 does not completely disappear, but rather is only partially pulled down by the backfill.

In one aspect, the settling strip 88 may be created by lifting up a portion of the filter fabric 80 underneath itself, thereby creating the segments 90, 92, 94. When the drainage system 20 has been installed, and before backfilling, the settling strip 88 may be held into place with one or more securement mechanisms 96, which may include any one or more of tape, an adhesive, one or more pins, or one or more clips. In one aspect, the one or more securement mechanisms includes one or more strips of tape applied to the filter fabric 80 near the one or more folds 86. In one aspect, the one or more securement mechanisms 96 include a plurality of staples applied near the folds 86, which provide support to keep the settling strip 88 in place until backfill occurs. In one aspect, enough filter fabric 80 is provided along the lower portion 87 to cover the entire board 22 before backfill, i.e., to make up for the filter fabric that is used to create the settling strip 88. In some aspects, a bottom end of the filter fabric is folded over one or more additional drainage features (not shown).

Still referring to FIGS. 5 and 6, the settling strip 88 is included to allow the lower portion 87 of the filter fabric 80 to slide against the front face 32 and settle downward when backfill is filled in against the drainage system 20. When the drainage system 20 has been installed against the foundation of a building, a builder then refills the surrounding area with backfill, which may include sand, gravel, soil, clay, or any other material within the ground. When installing the backfill, the immediate filling and further settling of the ground material pulls downward against the filter fabric 80, which creates tension in the filter fabric 80. In order to avoid distortion, tearing, or other breakage of the filter fabric 80 due to this tension, the settling strip 88 provides for slack in the filter fabric 80 such that during backfill, and during the process of the settling of the surrounding ground materials, the filter fabric 80 does not become overly taught. As a result, the purpose of the filter fabric 80, i.e., to prevent ground materials from entering the channels 40 of the drainage board 22, can be achieved long after the process of backfilling has occurred.

Figure 7:
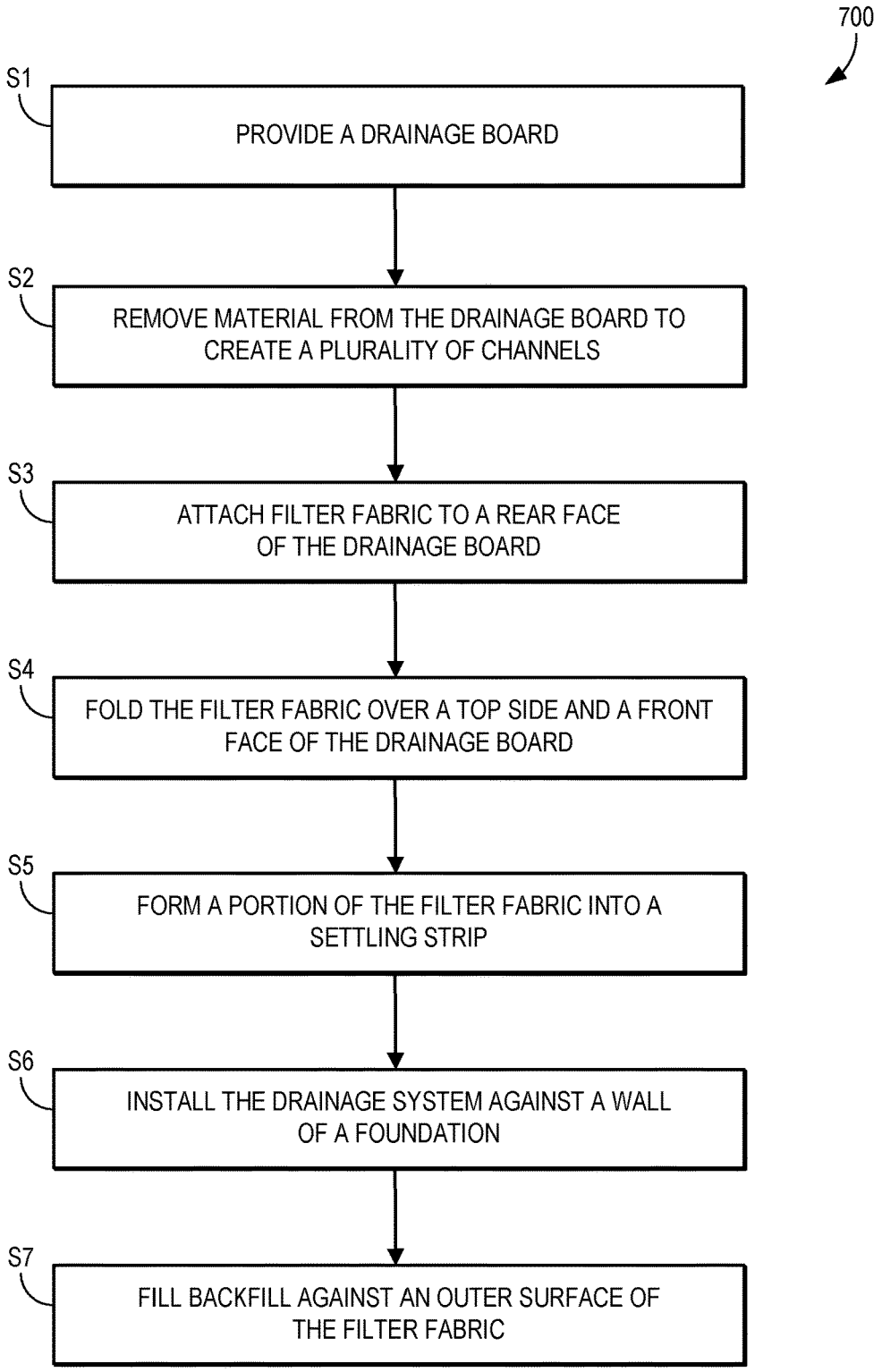
FIG. 7 is a flowchart illustrating a method of using the drainage board as disclosed herein.

Referring now to FIG. 7, a flow chart setting forth steps of a process 700 for utilizing the drainage system 20 disclosed herein is shown. Referring to step S1, the first step is to provide a board that can be used as the drainage board 22. The board may be made of any one of the aforementioned materials. Next, at step S2, the channels 40 are formed in the drainage board 22, e.g., with one or more saws or cutting devices. In one aspect, this step includes cutting the channels in a crisscross pattern, thereby creating the diamonds as discussed above. In another aspect, the board 22 may be provided with pre-formed channels, thereby combining steps S1 and S2. At step S3, the filter fabric 80 is attached to the rear face 34 of the drainage board 22. In an alternative embodiment, the filter fabric 80 may be attached to the top side 28 or the front face 32 of the drainage board 22. At step S4, the filter fabric 80 is folded over the top side 28 and the front face 32 of the drainage board 22. At step S5, the settling strip 88 is formed by folding a portion of the filter fabric 80 under itself twice over, thereby creating the segments 90, 92, 94. Next, the settling strip 88 is optionally secured using one or more securement mechanisms 96, which may be tape, staples, an adhesive, clips, or pins. At step S6, the drainage system 20 is installed against a wall of a foundation (not shown). At step S7, backfill is provided against the filter fabric 80, and, thus, a downward force is applied to the outer surface 82 of the filter fabric 80 and to the lower portion 87 of the filter fabric in particular. Initially and/or over time, this force pulls the filter fabric 80 downward, either immediately after replacement of the backfill or during settling of the backfill, until the filter fabric 80 no longer includes the settling strip 88 or until settling of the backfill is complete.

Some benefits of the drainage system 20 as described hereinabove will now be discussed. The extended filter fabric 80, i.e., inclusion of the settling strip 88, provides long term protection against soil clogging within the channels 40 of the drainage board 22. Further, the combination of insulation due to the preferred R-10 insulation rating, the drainage board 22 having crisscrossed channels 40, and the filter fabric 80 all in one provides cost savings for contractors, builders, and home and business owners. Further, due to the thickness of the drainage board 22, the drainage system 20 will not buckle and slide down the wall of the foundation as the backfill settles, as other drainage systems do. The configuration of the channels 40 described herein relieves hydrostatic pressure build up, and protects dampproofing systems that may be provided along the rear face 34 of the drainage board, or in some other location along the foundation. In some embodiments, the tongue 70 and groove 72 configuration of the drainage board 22 assists in proper installation of the drainage board 22 and allows for sealed joints. Previous drainage products made of fiberglass or mineral wool cannot stand up to compressive loads of compacted backfill without deforming and losing most of their drainage and insulating capacity.

Any of the embodiments described herein may be modified to include any of the structures or methodologies disclosed in connection with different embodiments. Further, the present disclosure is not limited to drainage board and/or filter fabrics of the types specifically shown and described. Still further, the drainage boards of any of the embodiments disclosed herein may be modified to work with various types of filter fabrics consistent with the disclosure herein.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the device disclosed herein and to teach the best mode of carrying out same. The exclusive rights to all modifications which come within the scope of the appended claims are reserved.

I claim:

1. A method of utilizing a drainage system, comprising:

attaching a filter fabric to a rear side of a drainage board;

folding the filter fabric over a top side and a front side of the drainage board;

forming a first portion of the filter fabric that is unattached from the drainage board into a settling strip, wherein the first portion is positioned above a second portion of the filter fabric that is at least partially unattached to the drainage board; and installing the drainage board against a wall of a foundation.

2. The method of claim 1, further comprising:

filling backfill against an outer surface of the filter fabric.

3. The method of claim 2, wherein the step of filling backfill against the outer surface of the filter fabric applies a downward force to the outer surface of the filter fabric.

4. The method of claim 3, wherein the settling strip disappears when the downward force is applied to the outer surface of the filter fabric.

5. The method of claim 1, further comprising:

applying a downward force to the filter fabric to partially pull down the settling strip.

6. The method of claim 5, wherein the downward force pulls the second portion downward relative to the drainage board.

7. The method of claim 1, further comprising:

securing the settling strip with a securement mechanism.

8. The method of claim 7, further comprising: removing material from the drainage board to create a plurality of channels.

9. The method of claim 8, wherein the step of removing material from the drainage board comprises cutting a plurality of crisscrossed channels within the front side of the drainage board.

10. The method of claim 8, wherein the step of installing the drainage board against the wall of the foundation comprises installing the rear side of the drainage board against the wall of the foundation.

11. The method of claim 8, wherein the step of forming a portion of the filter fabric into the settling strip comprises folding a portion of the filter fabric.

12. The method of claim 11, wherein the portion of the filter fabric is folded at least twice upon itself.

13. The method of claim 1, wherein the step of forming a portion of the filter fabric into a settling strip comprises forming a settling strip having an outer segment, an intermediate segment, and an inner segment.

14. A method of utilizing a drainage system, comprising:

attaching a filter fabric to a rear side of a drainage board, the drainage board having a plurality of channels on a front side thereof;

covering at least a portion of the front side of the drainage board with the filter fabric;

forming a portion of the filter fabric into a settling strip;

installing a rear side of the drainage board against a wall of a foundation; and applying a force to the settling strip, wherein the force transitions the settling strip from a first state to a second state.

15. The method of claim 14, further comprising:

releasably attaching the settling strip to a remainder of the filter fabric that covers the front side of the drainage board.

16. The method of claim 14, further comprising:

filling backfill against an outer surface of the filter fabric.

17. The method of claim 16, wherein the step of forming the portion of the filter fabric into the settling strip includes extending a first portion of the filter fabric away from the drainage board and positioning a second portion of the filter fabric between the drainage board and the first portion.

18. The method of claim 14, wherein application of the force pulls at least a portion of the filter fabric downward relative to the drainage board.

19. The method of claim 14, further comprising a step of covering at least a portion of a top side of the drainage board with the filter fabric.

20. The method of claim 14, wherein the step of forming a portion of the filter fabric into a settling strip comprises folding a first portion of the filter fabric over a second portion of the of the filter fabric.

* * * * *